United States Patent [19]

Inglis

[11] Patent Number: 4,673,146

[45] Date of Patent: Jun. 16, 1987

[54] MISSILE TAIL FIN ASSEMBLY

[75] Inventor: Ronald T. Inglis, Laguna Beach, Calif.

[73] Assignee: General Dynamics, Pomona Division, Pomona, Calif.

[21] Appl. No.: 721,056

[22] Filed: Apr. 8, 1985

Related U.S. Application Data

[62] Division of Ser. No. 523,472, Aug. 15, 1983, Pat. No. 4,588,145.

[51] Int. Cl.[4] ..... F42B 15/047

[52] U.S. Cl. ..... 244/3.23; 244/3.24; 244/3.29

[58] Field of Search ..... 244/3.23, 3.24, 3.25, 244/3.26, 3.27, 3.28, 3.29, 3.3, 90 R, 75 R

[56] References Cited

U.S. PATENT DOCUMENTS

| | | | |
|---|---|---|---|
| 1,005,127 | 10/1911 | Belcher | 244/90 R |
| 2,152,029 | 3/1939 | Cone | 244/215 |
| 3,117,520 | 1/1964 | Kerr et al. | 244/3.24 |
| 3,223,034 | 12/1965 | Robertson | 244/3.24 |
| 3,964,696 | 6/1976 | Orzechowski | 244/3.29 |
| 4,024,998 | 5/1977 | Rabinow et al. | 244/3.26 |
| 4,029,270 | 6/1977 | Niemeier | 244/3.23 |

FOREIGN PATENT DOCUMENTS

| | | | |
|---|---|---|---|
| 520064 | 6/1953 | Belgium | 244/3.23 |

*Primary Examiner*—Deborah L. Kyle
*Assistant Examiner*—Michael J. Carone
*Attorney, Agent, or Firm*—Henry M. Bissel; Edward B. Johnson

[57] ABSTRACT

An improved missle tail fin assembly. The missile utilizes four tail fin assemblies, each assembly comprising a fitting having three locking portions, each of which comprises a gudgeon having a pair of locking teeth, and a fin having mating recesses for the locking portions. A portion of the material associated with recesses of the two forward locks of each fin is removed, leaving clearances which permit limited rotation about the fin pivot axis in one direction only. When the fin is loaded in a direction to produce clockwise torque, all three locks which form the lock assembly are loaded approximately equal and this locates the elastic axis of the tail lock approximately just aft of the center of pressure which produces a small increase in cant angle with load. When the tail is loaded in the direction to produce a counterclockwise torque, the aft lock of the assembly will take all the torque. This moves the elastic axis further aft thus producing a larger increase in cant angle with load. The difference of these two changes in cant angle will be a net torque in the counterclockwise direction. When the deflection at the two forward lock positions reaches the clearance limit, all three locks will pick up the load and the surface will have the same stiffness as an unmodified tail fin.

7 Claims, 5 Drawing Figures

MISSILE TAIL FIN ASSEMBLY

The Government has rights in this invention pursuant to Contract No. DAAK40-77-C-0122, awarded by the U.S. Army.

This is a division of application Ser. No. 532,472, filed Aug. 15, 1983, now U.S. Pat. No. 4,588,145.

BACKGROUND OF THE INVENTION

1. Field of the Invention

This invention relates to missile aerodynamic surfaces and, more particularly, to providing an improved missile tail fin assembly for developing specific control of missile roll rate under certain flight conditions.

2. Description of the Prior Art

As is well known in the art, flight stability can be provided to a missile launched from a launching device, such as a rocket tube, by imparting a rolling motion thereto, normally in the counterclockwise (looking forward) direction. If the missile rolls too fast, guidance phasing errors can develop. If the missile rolls too slowly, roll-pitch coupling, in addition to phasing errors, can develop. With large angles of attack, however, the roll rate of the missile inherently slows because of aerodynamic damping which increases with increased angles of attack. What is desired is a system that compensates for all or some of the decay and also has minimal impact on cost, fin strength, flutter and aerodynamics associated with the fin assembly.

Most tube launched missiles have tail fin assemblies mounted to the rear of the missile body to provide missile stability during flight. The fins of the assembly are folded over in a manner such that the fins do not interfere with the launching. After launch, the fins are caused to extend outward by unfolding to a normal operating position. Prior art systems have been devised which allow the fins to be mounted to the missile body simply and securely. For example, U.S. Pat. No. 3,117,520 discloses a missile having a fitting formed therein in which a fin can be inserted. The fitting has spaced pins formed therein and the corresponding fin has a number of notches which correspond to the location of the spaced pins. The fitting also has a tapered slot arrangement such that when the fin is inserted into the notches and forced to the rear of the missile, a more secure mating between the fitting and the fin is provided. A locking device is also provided to further secure the fin assembly to the missile.

From the above discussion it can be seen that it would be very efficient from a cost standpoint if a tail fin assembly could be provided that both minimizes the roll rate decay problem described hereinabove and, in addition, functions to securely lock the fin assembly to the missile in the desired attitude for operational control. The present invention involves the modification of an existing missile tail fin assembly to achieve such a result.

SUMMARY OF THE PRESENT INVENTION

In brief, arrangements in accordance with the present invention comprise an improved missile tail fin assembly. In one embodiment, the missile utilizes a number of tail fin assemblies mounted on a collar which is attached to the missile. Each assembly comprises a fitting having two or more locking details, each of which comprises a single gudgeon having a pair of locking teeth, and a fin having a pair of mating recesses in the associated portion thereof. A portion of the material associated with recesses of the forward locks for each fin is removed. When the fin is loaded in a direction to produce clockwise torque about the fin mounting axis (which is the case for the left-hand fin with the missile in a nose-up attitude or for the right-hand fin with the missile in a nose-down attitude), all of the locks which form the lock assembly are loaded approximately equally and this locates the elastic axis of the tail fin approximately just aft of the center of pressure, which produces a negligible distortion of the fin and therefore only a slight increase in cant angle with load. However, when a tail fin is loaded in the direction to produce a counterclockwise torque about its mounting axis, the aft lock of the assembly takes all of the torque because of the clearances present in the forward locks. This moves the elastic axis further aft, thus permitting a larger distortion of the fin and a substantial increase in cant angle with load. The difference of these resulting cant angles for the two horizontal fins develops a net torque in the counterclockwise direction about the missile axis, thus tending to compensate for the tendency to decrease the roll rate at increased angles of attack. When the deflection at the forward lock positions of the fin undergoing distortion due to aerodynamic loading reaches the point where all of the clearances are taken up, all of the locks pick up the load and the fin will have the same stiffness as an unmodified tail fin. Thus the fin is adequately supported by the locks in the extended position, regardless of the direction of the aerodynamic side load on the fin.

As the missile rolls, each fin in turn comes into a position which permits the distortion of the fin, as just described, to develop an increased cant angle which produces aerodynamic forces reinforcing the roll rate of the missile, regardless of whether the nose of the missile is high or low relative to the missile path. Because of the clearances which are provided, the fins automatically discriminate between the distortion which occurs between right-hand and left-hand fin positions and depending on whether the angle of attack is positive or negative. Moreover, within the range of distortion which is permitted by the clearances in the forward lock positions, the degree of roll rate decay compensation is dependent upon the magnitude of the angle of attack, thereby automatically adjusting the degree of compensation to the tendency for roll rate decay which is also related to the magnitude of the attack angle.

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENT

Figure 1:
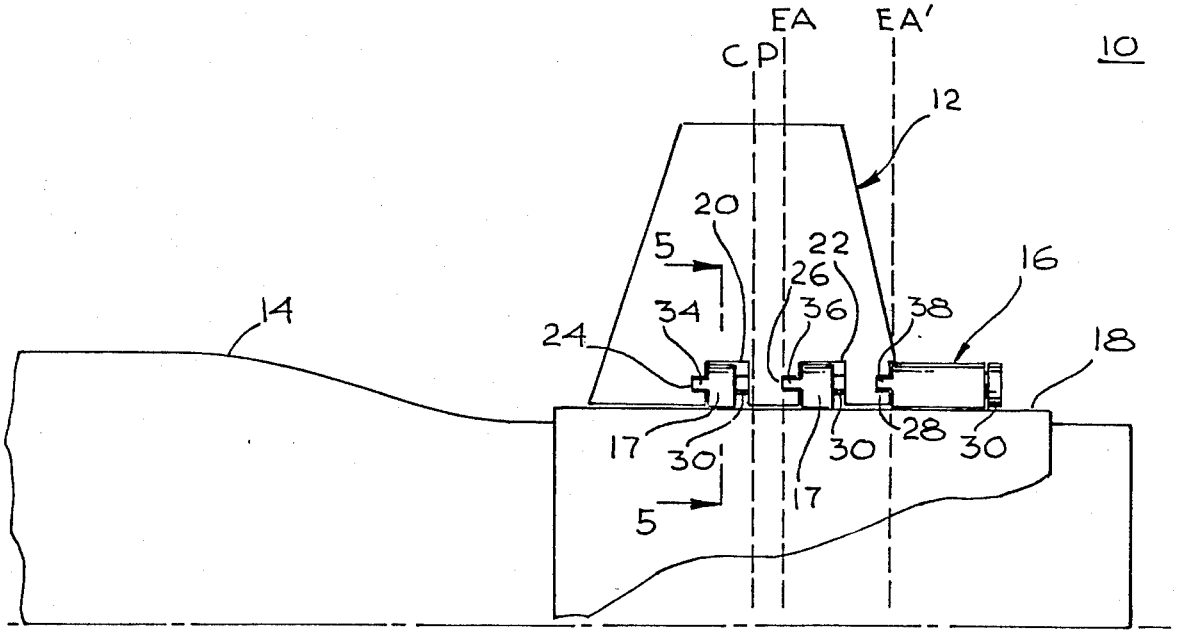
FIG. 1 is a partial side elevational view of a typical missile fin assembly of the present invention.

Referring to FIG. 1, a side elevational view of a typical missile fin assembly 10 in accordance with the teachings of the present invention is illustrated. The fin assembly 10 comprises a fin 12 (although only one fin assembly is shown, there will be preferably two or more such fin assemblies positioned at the aft portion of a missile 14), a locking mechanism 16 and a collar 18 mounted to the aft, or rear, of missile 14. As will be described in more detail with reference to FIG. 2, two notched areas 20 and 22, each including a horizontal slot area 24 and 26, respectively, and a third horizontal slot area 28 are formed in fin 12. Fin 12 is attached in a pivotable, or hinged, mounting on hinge pin 30 to collar 18 which in turn is mounted on the tail of missile 14. Fin 12 folds in against collar 18 so that missile 14 can be loaded into a launch tube. When the missile is fired, centrifugal force, due to the roll of the missile, or a torsion spring causes each fin 12 to flip outward, at which time a spring, mounted coaxially with hinge pin 30 within the member 16, drives the fin 12 rearward so that slots 24, 26 and 28 engage locking teeth 34, 36 and 38, respectively, on the gudgeons 17 of collar 18.

The tail fin 12 is shown provided with three locking portions, or locks, each of which comprises a single gudgeon having a pair of locking teeth (on the collar side of the mounting) and a pair of mating recesses, or slots, in the associated portion of tail fin 12.

The configuration of the tail fin 12 relative to the three locks is normally such that the center of pressure (CP) is slightly forward of the elastic, or twist, axis (EA) of the fin and thus produces a small increase in cant angle as the pressure of the aerodynamic forces increases (as the missile angle of attack increases). The normal direction of roll imparted to missile 14 is counterclockwise (CCW) looking from aft to forward and the design roll rate is about 12 r.p.s., the acceptable band or range of roll rate being limited. If missile 14 rolls too fast, phasing errors may occur. If it rolls too slowly, roll-pitch coupling, in addition to phasing errors, may develop. With large angles of attack, the roll rate of the missile inherently slows because of aerodynamic damping which increases with increasing angles of attack. In order to compensate for this it is desired to create more torque on missile 14 in the desired, or CCW, direction as the angle of attack increases while developing negligible effect at zero or low angles of attack where roll rate decay is not a problem.

Figure 2:
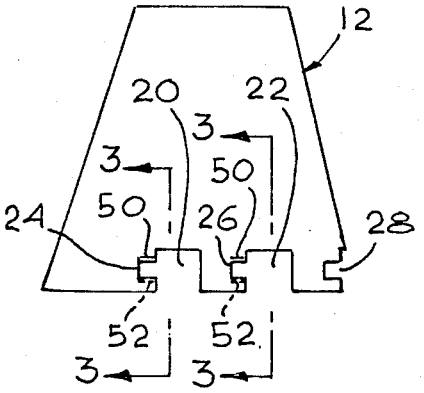
FIG. 2 is a side elevational view of a fin modified in accordance with the teachings of the present invention.
Figure 3:
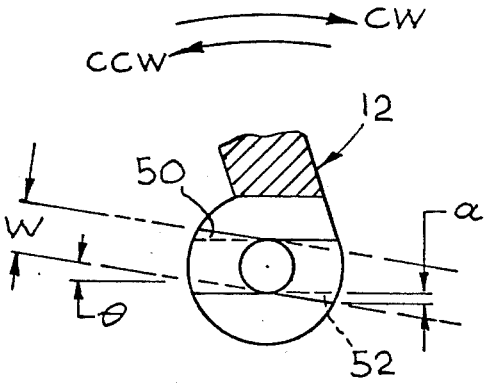
FIG. 3 is a cross-sectional view taken along lines 3—3 of FIG. 2 for more fully illustrating the novel design of the present invention.

In accordance with the teaching of the present invention, a single technique which has a minimum impact on cost, strength, flutter or aerodynamics of existing tail fin designs, has been developed. In particular, FIG. 2 shows a side elevation of the disassembled fin and shows special added cuts 50 and 52 made in the notch areas of the two forward locks to provide the novel design of the present invention. FIG. 3 is a cross-sectional view along line 3—3 of FIG. 2 looking forward from the aft portion of the missile, clearly illustrating how the two forward lock sections are modified to develop this compensation. For purposes of clarity, the view shows the lock sections without the locking teeth in engagement with the slot areas 24 and 26.

The present invention modifies the tail fin 12 so the air load on the tail will increase the cant angle when the tail fin 12 is producing CCW torque and reduce or have no effect when it is producing CW torque. This desired result is accomplished with a simple mill cut on the two forward locks of each tail fin 12 while the aft lock is not changed.

In particular, during the fabrication of each tail fin 12, additional material is milled, or otherwise removed, from diagonally opposite sides of the two forward lock sections to form wedge-shaped areas 50 and 52. The angle $\theta$ of the cut is preferably in the range from about 4° to about 6° and the maximum extent of the cut, indicated by reference letter "a", is approximately 0.005 inches, the preferred range of this cut being from about 0.004 to about 0.006 inches. The width W (in the range from about 0.08 inches to about 0.12 inches) and angle $\theta$ can be selected to give the desired change in cant angle between opposite tail fins.

When the tail fin 12 is loaded in the direction shown to produce CW torque, all three locks are loaded approximately equally, thereby locating the elastic axis of the tail lock assembly just aft of the center of pressure, thus producing a small increase in cant angle with load.

When the tail fin is loaded in the direction to produce CCW torque (i.e., when the missile is initially caused to roll in the CCW direction after launch) the aft lock will take all the torque. This moves the elastic axis aft approximately 0.60 inches which will produce a larger increase in cant angle with load (i.e., as the attack angle increases). The difference of these two changes, $\Delta CCW - \Delta CW$, will be the net additional torque in the CCW direction.

When the deflection at the two forward lock positions is sufficient, (approximately 0.005 inches), all three locks will pick up the load, and the tail surface will have the same stiffness as an unmodified tail.

Figure 4:
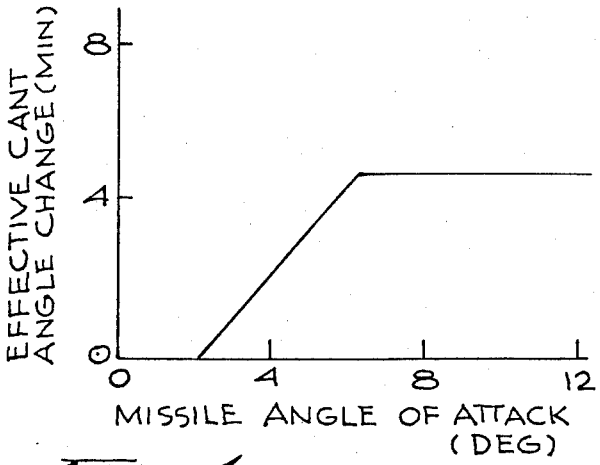
FIG. 4 is a graph illustrating the typical effect of cant angle change as a function of the missile angle of attack.

FIG. 4 is a graph illustrating the manner in which the present invention maintains the missile roll rate as the missile angle of attack increases. As shown, the effective cant angle change (the cant angle change required on all four tail fins to produce the same torque) increases substantially linearly with increasing missile angle of attack (after beginning at substantially zero) until all three locks pick up the load, at which time the effective cant angle remains constant for larger angles of attack.

Figure 5:
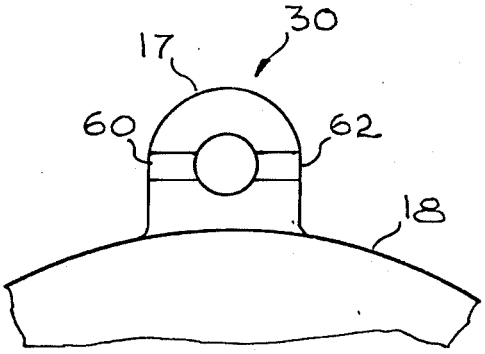
FIG. 5 is a view along line 5—5 of FIG. 1 with the fin removed, looking in the direction of the arrows.

FIG. 5 is a cross-sectional view along line 5—5 of FIG. 1 and shows a pair of locking teeth 60 and 62 on opposite sides of the central bore of hinge mechanism 30.

Although there has been described above one specific arrangement of a missile tail fin assembly in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. The method of compensating for roll rate decay from a predetermined roll rate of a missile having a plurality of tail fins for establishing said predetermined roll rate in flight, each tail fin being mounted to the missile on a pivot axis by at least two longitudinally displaced locking mechanisms that are located respectively forward and rearward of the center of pressure of the fin, each locking mechanism including a plurality of teeth and mating slots limiting the pivotal movement of an associated portion of the fin, the decay of said predetermined roll rate resulting from missile flight at increased angles of attack, comprising the steps of:

permitting only a portion of a tail fin to pivot about said axis when in flight while preventing the remainder of the tail fin from pivoting, thereby introducing a change of fin orientation to develop said roll rate compensation.

2. The method of claim 1 wherein said steps include permitting the portion of the tail fin associated with the forward locking mechanism to pivot while preventing the portion associated with the rearward mounting member from pivoting.

3. The method of claim 2 wherein the step of permitting pivotal movement of the forward portion comprises permitting said pivotal movement in only one direction and preventing pivotal movement thereof in an opposite direction, relative to an initial extended position of the fin.

4. The method of compensating for roll rate decay from a predetermined roll rate of a missile having a plurality of tail fins for establishing said predetermined roll rate in flight, each tail fin being mounted to a collar on the missile by at least two longitudinally displaced locking mechanisms that are located respectively forward and aft of the center of pressure of the fin, each locking mechanism including a plurality of locking teeth and mating slots limiting circumferential displacement of the associated portion of the fin, the decay of said predetermined roll rate resulting from missile flight at increased angles of attack, comprising the steps of:

selectively modifying the sides of at least one of said slots to permit increased circumferential travel of the associated portion of the fin in a preselected direction, thereby shifting the elastic axis of the fin rearwardly relative to the center of pressure.

5. The method of claim 4 wherein each tail fin is mounted to the missile by three longitudinally displaced locking mechanisms, the modifying step comprising the steps of removing material from diagonally opposite sides of the slots of two of said locking members while maintaining the slots of the third locking member fixed in position to shift the elastic axis of the fin rearwardly relative to the center of pressure.

6. The method of claim 4 including the step of providing an increased space between the teeth and selected sides of the slot of the forward locking member relative to the corresponding spaces of the rearward locking member to permit twisting of the tail fin in a direction to counter said roll rate decay under aerodynamic forces encountered by the fin only at predetermined positions during missile roll in flight.

7. The method of claim 4 wherein each tail fin is mounted on a pivot axis and retained in an extended position by said locking members, further including the step of permitting only a portion of a tail fin to pivot about said axis when extended in flight while preventing the remainder of the tail fin from pivoting, thereby introducing a change of fin orientation to develop said roll rate compensation.

* * * * *